United States Patent [19]

Halverson

[11] Patent Number: 4,610,061

[45] Date of Patent: Sep. 9, 1986

[54] LOW VELOCITY EXPANDING PROJECTILE

[75] Inventor: Henry J. Halverson, Collinsville, Ill.

[73] Assignee: Olin Corporation, Stamford, Conn.

[21] Appl. No.: 742,386

[22] Filed: Jun. 10, 1985

Related U.S. Application Data

[60] Continuation of Ser. No. 545,596, Oct. 26, 1983, abandoned, which is a division of Ser. No. 280,769, Jul. 6, 1983, abandoned.

[51] Int. Cl.[4] ..... B21K 21/06; F42B 11/10

[52] U.S. Cl. ..... 29/1.23; 102/509

[58] Field of Search ..... 29/1.2–1.23; 102/507–510, 514–516

[56] References Cited

U.S. PATENT DOCUMENTS

| | | | |
|---|---|---|---|
| 1,135,357 | 4/1915 | Ayne | 102/508 |
| 1,633,168 | 6/1927 | Dickerson | 29/1.22 |
| 1,833,645 | 11/1931 | Hartz | 102/508 |
| 2,573,634 | 10/1951 | Whipple | 29/1.23 |
| 2,838,000 | 6/1958 | Schreiber | 102/507 |
| 3,143,966 | 8/1964 | Burns, Jr. et al. | 102/507 |
| 3,349,711 | 10/1967 | Darigo et al. | 102/509 |
| 4,193,348 | 3/1980 | Halverson | 102/509 |

FOREIGN PATENT DOCUMENTS

| | | | |
|---|---|---|---|
| 4426 | of 1899 | United Kingdom | 102/507 |

*Primary Examiner*—Howard N. Goldberg
*Assistant Examiner*—Steven Nichols
*Attorney, Agent, or Firm*—Bruce E. Burdick

[57] ABSTRACT

A projectile for a centerfire cartridge that achieves maximum energy transfer with limited target penetration when fired from snub-nosed pistols. A hollow point lead bullet is provided with an aluminum jacket of sufficient hardness to avoid fouling the pistol barrel and which allows the cartridge containing the projectile to feed reliably in auto-loading pistols and yet does not restrict normal expansion of the bullet upon impact with the target. The jacket extends into the nose recess of the bullet and covers the peripheral portion of the bullet base, whereby the jacket is securely fastened to the bullet and separation subsequent to impact is prevented. The jacket is uniformly notched at the nosetip annulus to weaken the aluminum jacket and promote upset at surprisingly low impact velocities.

A method of fabricating the projectile is also disclosed in which a cup-shaped aluminum jacket is partially filled with a lead core and simultaneously the cup base is notched before being formed into a hollow point bullet nose configuration. The notches can thus be uniformly controlled in contrast to slitting or cutting before or after forming in which the sharpness and force applied to the cutting knife governs the size of the slit or cut in a hard to control fashion.

1 Claim, 7 Drawing Figures

LOW VELOCITY EXPANDING PROJECTILE

This is a continuation, of application Ser. No. 06/545,596 filed Oct. 26, 1983 now abandoned, which is a divisional of application Ser. No. 06/280,769, filed July 6, 1983, now abandoned.

BACKGROUND

The present invention relates to small arms ammunition and, more particularly, to a hollow-point projectile designed for an auto-loading pistol.

Recently, several law enforcement agencies, including the Law Enforcement Assistance Administration (L.E.A.A.) have developed criteria for the selection of handgun ammunition for use by law enforcement officers. In general, the criteria are: maximum muzzle energy, optimum penetration, minimum weight loss or fragmentation upon upset, and acceptable pressure loading, accuracy and reliability.

Optimum penetration is defined as six inches or less in tissue simulating gelatin. This limitation was adopted to protect bystanders who might otherwise be injured by a projectile passing through the intended target and further serves to insure that all the projectile energy is transferred to the target and that the bullet ends up in one piece in the target and can be recovered for use as evidence. High rates of energy transfer, coupled with a high muzzle energy, are desirable to instantaneously disable the target, thereby preventing return fire on the law officers and eliminating the need for further fire on the target.

High energy transfer commonly called "punch" or "knock-down power", coupled with controlled or limited projectile penetration, is conventionally achieved by use of a "hollow point" configuration wherein a centrally disposed axially directed recess is provided in the projectile nose. Such a recess weakens the projectile nose structurally and provides outward forces in the recess since target material flowing into the recess as the bullet penetrates the target has nowhere to go but material flowing past the tip is largely unrestricted such that, upon impact, an unjacketed lead projectile "mushrooms," opening outwardly and backwardly, thereby presenting a greatly increased frontal area.

Reliability of auto-loading pistol and revolver ammunition is measured in terms of uniformly predictable successful functioning in an auto-loading pistol, a type of weapon being adopted by an increasing number of law enforcement agencies for increased fire power and ease of operation.

To insure proper feeding, and prevent "jamming," the projectiles, generally formed of lead or a soft lead alloy, must resist deformation, especially deformation of the projectile nose, prior to firing. Deformation resistance is presently achieved through the provision of a protective covering or jacket, generally of brass or, less frequently, steel.

Unfortunately, the jackets of many of the presently available fully jacketed auto-loading ammunition, while preventing deformation prior to firing, also prevent the desired mushrooming upon impact. This may result in the projectile passing completely through the target and being lost as evidence and not achieving the desired instantaneous disablement. A bystander may then be injured by the projectile, either by being in the path of the bullet as it exits the initial target, or by a ricochet off a hard object such as a building or automobile.

This problem becomes particularly acute in bullets for the lower velocity (e.g. less than about 950 feet per second muzzle velocity) pistols and revolvers such as snubnosed 0.38 specials, 0.380 Auto caliber and 0.45 Auto and Long Colt caliber handguns being increasingly used by undercover or plainclothes policemen, where the short barrel lengths do not give sufficient impact velocity (greater than about 950 f.p.s.) to produce upset or mushrooming of present aluminum jacketed bullets loaded to maximum safe pressure levels.

Attempts at promoting mushrooming of a jacketed, hollow point projectile have generally involved internal or external scoring, slitting or otherwise weakening the fully formed jacket in the area of the projectile nose. For example, U.S. Pat. Nos. 2,765,738 and 2,838,000 show internal jacket scoring methods while U.S. Pat. No. 3,349,711 shows external scoring of a copper plated rifle varmint bullet designed to fragment. Projectiles of this type have not been believed to be satisfactory for police use since the degree of expansion and depth of penetration are highly dependent on the projectile's velocity at the point of impact and also on the uniformity among projectiles of the method used to weaken the jacket material. Specifically, I have found that upon impact at such low velocities (less than about 950 f.p.s.) brass or copper-jacketed hollow point projectiles would not expand whether notched or unnotched, thereby allowing them to pass through the target. To the layman this seems crazy as one would not expect that the slower the bullet travels the *more* likely the bullet is to pass through the victim. But, with soft-point ammunition that is the case since bullet expansion does not occur.

One particularly successful solution to the need for reliable mushrooming for muzzle velocities in the range of 950–1,200 f.p.s. is that disclosed in U.S. Pat. No. 4,193,384, namely, a purposefully unnotched jacket having a sufficient hardness (between about 45 and 60 as measured by the Rockwell R-15T Hardness Tester) and shear strength (between about 12,000 and about 24,000 p.s.i.) so that it would not foul the gun barrel but yet would allow upset to occur.

However, there is a need to attain this mushrooming effect with low muzzle velocity (<950 f.p.s.) pistols and revolvers for which such has been heretofor unsuccessful.

There is, thus, a need for a more dependable expanding bullet for low muzzle velocity pistols such as snub nosed (e.g. 2" barrels) pistols in order to allow for reduced weight, easier handling pistols.

SUMMARY OF THE INVENTION

The present invention is a projectile designed especially, but not exclusively, for a low velocity autoloading pistol which provides maximum energy transfer with optimum target penetration. This is accomplished, in general, by combining a hollow-point bullet and a frontal, notched tip jacket having suitable hardness and strength characteristics. More particularly, I have discovered that a frontal, notched tip jacket formed of a metal having a hardness of between about 45 and about 60 as measured by the Rockwell R-15T Hardness Test and a shear strength of between about 12,000 and about 24,000 p.s.i. will provide the necessary deformation protection to assure reliable feeding in a low velocity auto-loading weapon while not preventing expansion or mushrooming of the projectile upon impact.

One material, meeting the aforementioned criteria, which may be advantageously employed in the practice of the present invention is aluminum and certain of its alloys.

Upon careful analysis, as noted in my earlier U.S. Pat. No. 4,193,348, I have determined that barrel fouling with aluminum jacketed projectiles is a function of projectile velocity and that such fouling becomes a significant factor only at muzzle velocities in excess of about 1,200 f.p.s. Thus, these materials are suitable for use in pistol projectiles which typically attain muzzle velocities below about 1,200 f.p.s. However, at that time I felt and said that notching was not desirable since the majority of handguns in use had barrels of a length that produced bullet velocities greater than 950 f.p.s.

It is a further aspect of the invention that the jacket overlaps a peripheral portion of the bullet base and enters partially into the recess in the bullet nose, whereby the jacket is securely attached to the bullet. I have discovered that the presence of a jacket on the re-entrant surface of the recess momentarily retards mushrooming which otherwise would result in excessive energy deposition on the target surface while the notching of the jacket surprisingly allows this desirable jacket to be effectively used on bullets for use in pistols with low velocities where jacketed tips were heretofore thought unacceptable. The jacket overlap into the recess is a feature which reduces the possibility of separation of the jacket from the bullet subsequent to impact, as the jacket now becomes crimped into the bullet material as the bullet expands and folds back upon itself so a more uniform projectile is provided having more consistent upset performance and less velocity dependence. Also, having the jacket material flow around the annulus of the nose and into the nose cavity eliminates possibility of burrs or sharp corners on the nose tip (as present on some brass jacketed bullets) and thereby reduces possibility of the cartridge jamming on a pistol feed ramp during cycling of a pistol when fired.

The projectile described above may be advantageously fabricated by a novel method wherein a bullet blank (core) and cup-shaped jacket blank are swaged together during which the flat top is scored and then the cup base and underlying bullet are then pierced so as to form the bullet recess and fold the scored top to make a notched tip, a portion of the jacket being driven into the recess during the piercing and cavity formation step.

BRIEF DESCRIPTION OF THE DRAWING

The various objects and advantages of the invention will be more clearly understood through reference to the following detailed description and the accompanying drawing wherein.

DESCRIPTION OF THE PREFERRED EMBODIMENT

Figure 1:
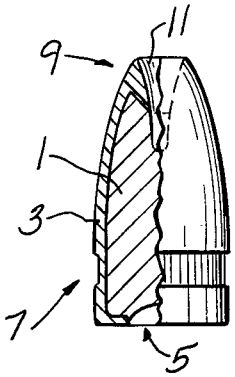
FIG. 1 is a side elevational view, partly in cross-section, of one embodiment of the projectile of the present invention.

As seen in FIG. 1, the projectile of the present invention comprises a soft metal bullet 1, preferably formed of lead or a lead alloy, and a notched metal jacket 3.

The bullet 1 includes a substantially planar annular base 5, a cylindrical body 7, and an arcuate frustoconical nose 9 having a centrally disposed, axially aligned cylindrical, flared-nose recess 11. Bullets of this general type are commonly known by the generic designation "hollow point."

The jacket 3, of substantially uniform thickness, overlies the front end or "tip" of the side of body 7 and extends over the peripheral portion of the base 5 and into the recess 11 of the bullet 1.

Jacket material is chosen from the group of metals having a hardness of between about 45 and about 60 and a shear strength of between 12,000 and 24,000 p.s.i. These values are characteristic of most aluminum and of zinc alloys.

As indicated by the following table, comparison of the projectiles of the present invention with commercially available projectiles reveals marked superiority in penetration, energy deposition and reliability.

COMPARATIVE EVALUATION

| Barrel Length | Muzzle Velocity | % of Projectiles Mushrooming Upon Impact | Projectile Type |
|---|---|---|---|
| 2" | 950 f.p.s. | 100% | Notched 95Gr. Al JHP .38 Spl. +P |
| 2" | 950 f.p.s. | <50% | Unnotched 95Gr. Al JHP .38 Spl. +P |
| 4" | 715 f.p.s. | 100% | Notched 225Gr. Al JHP .45 Colt |
| 4" | 715 f.p.s. | 0% | Unnotched 225Gr. JHP .45 Colt |
| 3¾" | 970 f.p.s. | 100% | Notched 85Gr. Al JHP .380 Auto |
| 3¾" | 970 f.p.s. | <75% | Unnotched 85Gr. Al JHP .380 Auto |
| 3¼" | 935 f.p.s. | 100% | Notched 85Gr. Al JHP .380 Auto |
| 3¼" | 935 f.p.s. | <25% | Unnotched 85Gr. Al JHP .380 Auto |

The above table is most surprising and important for police officers using the projectile types (0.38 +P, 0.380 or 0.45) in short barreled guns. Note: these barrel lengths are shorter than what the arms industry considers to be standard lengths.

In a further test, five 115 grain, cal. 9mm projectiles were fired, with a muzzle velocity of 1125 f.p.s., into gelatin blocks. None of the projectiles penetrated beyond five inches and no individual projectile had a weight loss exceeding three grains. In this regard, it is significant to note that the L.E.A.A. criteria for weight loss of 5% of projectile weight is nearly twice the rate demonstrated by the present invention.

This test demonstrates that the novel jacket configuration prevents separation of the jacket from the bullet. By means of an overlapped base portion and a reentrant nose portion, the jacket is securely attached to the bullet.

Notches 12 are preferably initially placed on the bottom of cup 23 when the blank core 21 and blank cup 23 are swaged to form tip 25. Specifically, the notches are preferably formed by means of ridges on the tip-forming tool used to form the nose or front end of the swaged preform of FIGS. 3, 3A and 4, thus thinning the blank in the area of notches 12. The notches are added at this stage because the notch depth and pressure can be quite uniformly, accurately and reliably made from one bullet preform to the next, thus avoiding the variability of a knife-type notching procedure which operates generally as an intermediate step between lead seating and finish forming.

In FIGS. 2–5, 3A and 5A there is shown a series of steps for fabricating a projectile in accord with the present invention.

Figure 2:
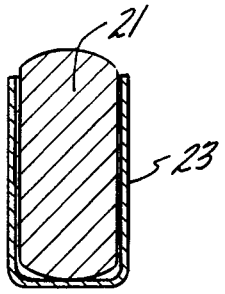
FIGS. 2–5 are diametrical cross-sectional views illustrating the steps of a method of fabricating the projectile of FIG. 1.

In FIG. 2, there is shown a bullet blank or core 21 disposed within a jacket blank or cup 23.

Figure 3A:
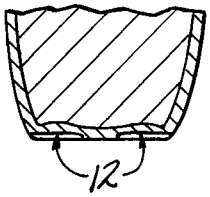
FIGS. 3A and 5A are enlarged views of portions of FIGS. 3 and 5 showing the projectile tip structure.
Figure 3:
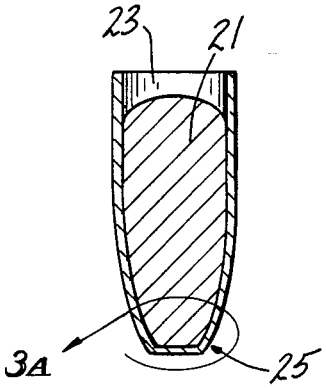
Figure 4:
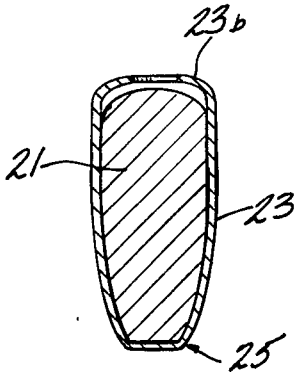

In FIGS. 3, 3A and 4, the core 21 and cup 23 have been swaged together, by means well known in the art, so as to form an arcuate frusto-conical nose 25 in the closed end of the cup 23 and simultaneously put notches 12 on the flat frontal portion. The diameter of the nose #25 is preferably 8–12% greater than final nose diameter #16 so that resultant notches preferably start about 0.010"–0.030" from tip on ogive and preferably stop at least about 0.020"–0.050" into cavity from tip. 6–8 notches appear to be an optimum number. The notches 14 may or may not cut completely through the jacket portions 18.

Figure 5A:
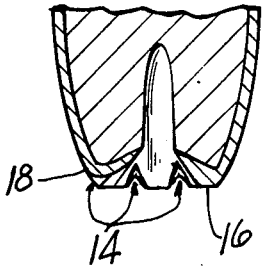
Figure 5:
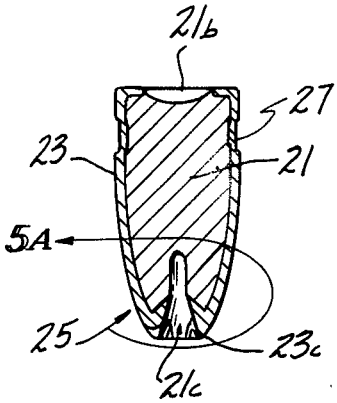

The distal portion **23*b* of the cup 23 is folded inwardly into position prior to a final swaging operation that produces the finished projectile as seen in FIG. 5**.

The nose 25 has been narrowed slightly so as to place the lip 16 of the tip 25 in line with preform notches 12 to produce final notch having thinned jacket areas 18 and the nose 25 is simultaneously pierced to form the recess **21*c*. During the piercing operation, a portion 23*c* of the cup 23 is driven into the recess 21*c*. Formation of this reentrant portion 23*c* and, notches 14, are made possible because of the easy formability of the material of the jacket blank 23**.

If desired, an annular knurled band 27 may be formed in the jacket, rearward of the midpoint of the projectile, and filled with a suitable lubricating material, thereby increasing the maximum muzzle velocity at which the projectile of the present invention may be advantageously employed and reducing the possibility of barrel fouling.

While the specific details of my invention have been shown and described herein, the invention is not confined thereto as various changes and alterations can be made without departing from the spirit thereof as defined in the appended claims.

What is claimed is:

1. A method of uniformly notching an upsetting nonfragmenting jacketed hollow point projectile for pistol ammunition which method comprises the steps of:

(a) inserting a lead core forwardly into a rearwardly opening cuplike aluminum jacket to form a jacketed core having a longitudinal axis;

(b) forming said jacketed core into a projectile preform having the base of said jacket cup facing forward and forming a flat circular frontal area on said projectile preform the frontal area being orthogonal to the longitudial axis;

(c) simultaneously with said preforming step, uniformly notching but not splitting said flat front of said preform while leaving the ogive of said preform unnotched;

(d) axially recessing the nose of said jacketed preform to produce a hollow point cavity; and (c) forming said notched preform into a final projectile by reducing the flat front of said notched preform so that said notches extend from the ogive, pass over an annular nose rim of said projectile and terminate in said cavity, whereby to produce a bullet which uniformly upsets without fragmentation upon target impact.

* * * * *